US012195228B2

(12) United States Patent
Hung

(10) Patent No.: US 12,195,228 B2
(45) Date of Patent: Jan. 14, 2025

(54) ASSEMBLABLE PALLET

(71) Applicant: Fa Hung, Kaohsiung (TW)

(72) Inventor: Fa Hung, Kaohsiung (TW)

( * ) Notice: Subject to any disclaimer, the term of this patent is extended or adjusted under 35 U.S.C. 154(b) by 67 days.

(21) Appl. No.: 18/181,827

(22) Filed: Mar. 10, 2023

(65) Prior Publication Data

US 2024/0300694 A1 Sep. 12, 2024

(51) Int. Cl.
*B65D 19/00* (2006.01)
*B65D 19/08* (2006.01)

(52) U.S. Cl.
CPC ..... *B65D 19/0097* (2013.01); *B65D 19/08* (2013.01); *B65D 2519/00024* (2013.01); *B65D 2519/00059* (2013.01); *B65D 2519/00094* (2013.01); *B65D 2519/00567* (2013.01)

(58) Field of Classification Search
CPC ..... B65D 19/0097; B65D 19/08; B65D 2519/00024; B65D 2519/00059; B65D 2519/00094; B65D 2519/00567
See application file for complete search history.

(56) References Cited

U.S. PATENT DOCUMENTS 3,645,215 A * 2/1972 Kirkpatrick ..... B65D 19/0069 108/57.1
4,485,744 A * 12/1984 Umemura ..... B65D 19/0095 108/57.18
2007/0089647 A1* 4/2007 Vanderlei ..... B65D 19/0095 108/57.34
2007/0163978 A1* 7/2007 Hung ..... A47B 47/00 211/189
2007/0245932 A1* 10/2007 Nielsen ..... B65D 19/0093 108/51.11
2010/0175595 A1* 7/2010 Grietens ..... B65D 19/0095 108/51.3
2020/0239185 A1* 7/2020 Park ..... B65D 19/0095

FOREIGN PATENT DOCUMENTS

| | | | | |
|---|---|---|---|---|
| DE | 202006001449 U1 * | 5/2006 | ..... | B65D 19/0048 |
| DE | 202019104654 U1 * | 10/2019 | | |
| JP | 2004142829 A * | 5/2004 | | |
| KR | 200328197 Y1 * | 9/2003 | | |
| KR | 200331090 Y1 * | 10/2003 | | |
| KR | 200347736 Y1 * | 4/2004 | | |
| KR | 20050040658 A * | 5/2005 | | |
| KR | 100661338 B1 * | 12/2006 | | |
| KR | 200325402 Y1 * | 9/2009 | | |
| KR | 20120033663 A * | 4/2012 | | |
| KR | 101153848 B1 * | 6/2012 | | |
| KR | 101632331 B1 * | 6/2016 | | |
| KR | 102268782 B1 * | 6/2021 | | |
| WO | WO-2022175859 A1 * | 8/2022 | ..... | B65D 19/0095 |

* cited by examiner

*Primary Examiner* — Hanh V Tran
(74) *Attorney, Agent, or Firm* — Rosenberg, Klein & Lee

(57) ABSTRACT

An assemblable pallet is provided. The assemblable pallet mainly includes a plurality of top plates, a plurality of bottom plates, a plurality of upper support plates, a plurality of lower support plates, and a plurality of feet stacked correspondingly. The above plates are all sheets. Then a plurality of fasteners is inserted through corresponding fastening holes of the above plates and bent to be locked at the fastening holes. Thus the plurality of plates is combined to form a pallet which can be assembled and disassembled more easily and conveniently.

10 Claims, 13 Drawing Sheets

ASSEMBLABLE PALLET

BACKGROUND OF THE INVENTION

Field of the Invention

The present invention relates to a pallet, especially to an assemblable pallet.

Description of Related Art

Generally, an assemblable pallet available now is formed by fasteners such as screws or rivets inserted through corresponding insertion holes on respective sheets for connecting and fixing the sheets. It takes quite a lot time to assemble and disassemble the pallet. When tools used don't match/mate with the fasteners, the pallet is difficult to be assembled or separated. Moreover, the sheets are loosened, separated unexpectedly and further posing a danger to users when the fasteners such as screws are subjected to vibration.

SUMMARY OF THE INVENTION

Therefore, it is a primary object of the present invention to provide an assemblable pallet which is formed by sheets connected with one another in a locked manner for being assembled and disassembled more easily.

In order to achieve the above object, an assemblable pallet according to the present invention is formed by the following way. A plurality of top plates, a plurality of bottom plates, a plurality of upper support plates, a plurality of lower support plates, and a plurality of feet are stacked correspondingly. The above plates are all sheets Then a plurality of fasteners is inserted through corresponding fastening holes of the above sheets and bent to be locked at the fastening holes. Thus the all sheets are combined and fixed to form a pallet which can be assembled and disassembled more easily and conveniently.

DETAILED DESCRIPTION OF THE PREFERRED EMBODIMENT

Figure 1:
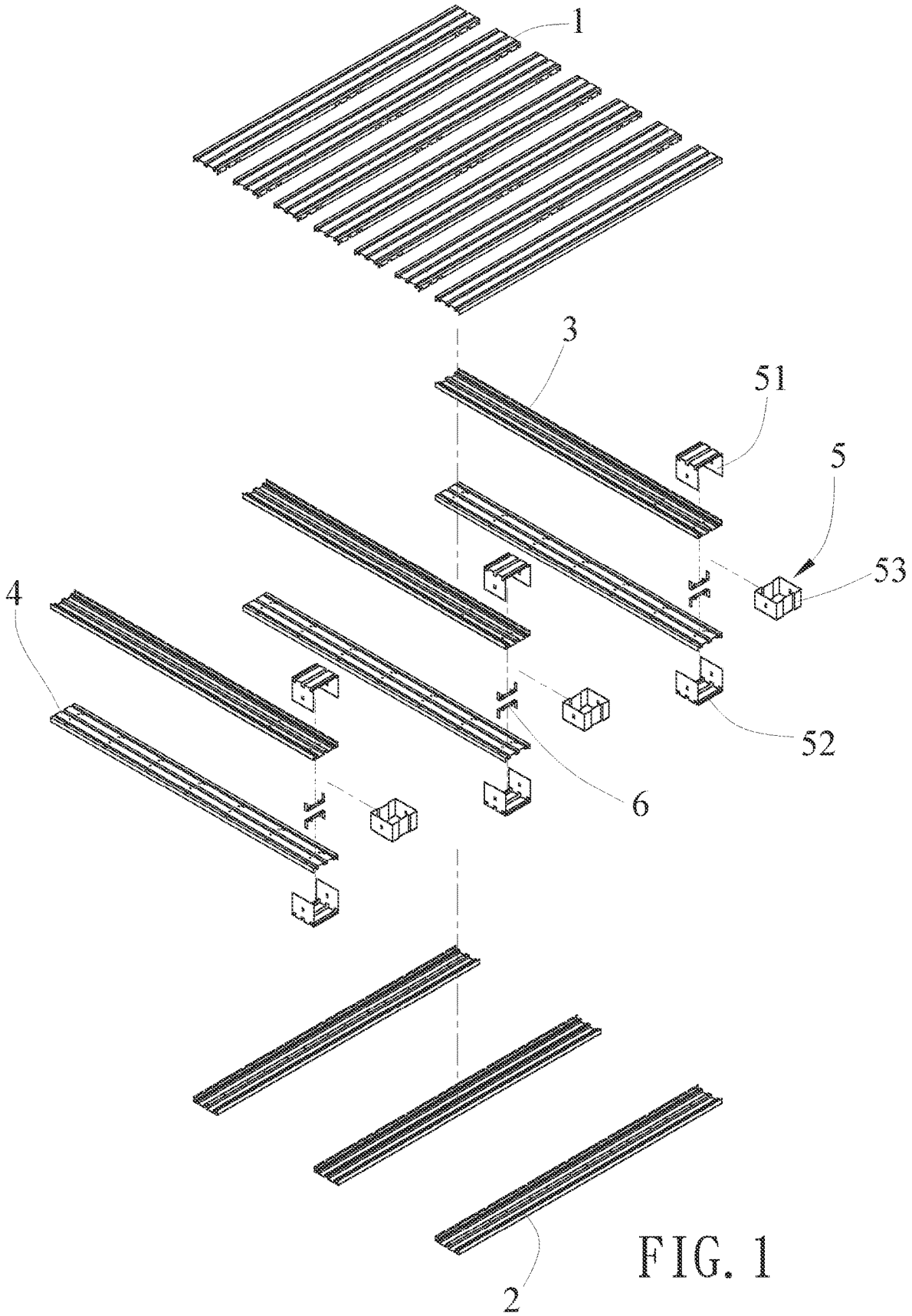
FIG. 1 is an exploded view of an embodiment according to the present invention.

Refer to FIG. 1, an assemblable pallet according to the present invention mainly includes a plurality of top plates 1, a plurality of bottom plates 2, a plurality of upper support plates 3, a plurality of lower support plates 4, a plurality of feet 5, and a plurality of fasteners 6. The top plates 1, the bottom plates 2, the upper support plates 3, the lower support plates 4, the feet 5, and the fasteners 6 are made of metals such as aluminum or steel coated with zinc.

Figure 2:
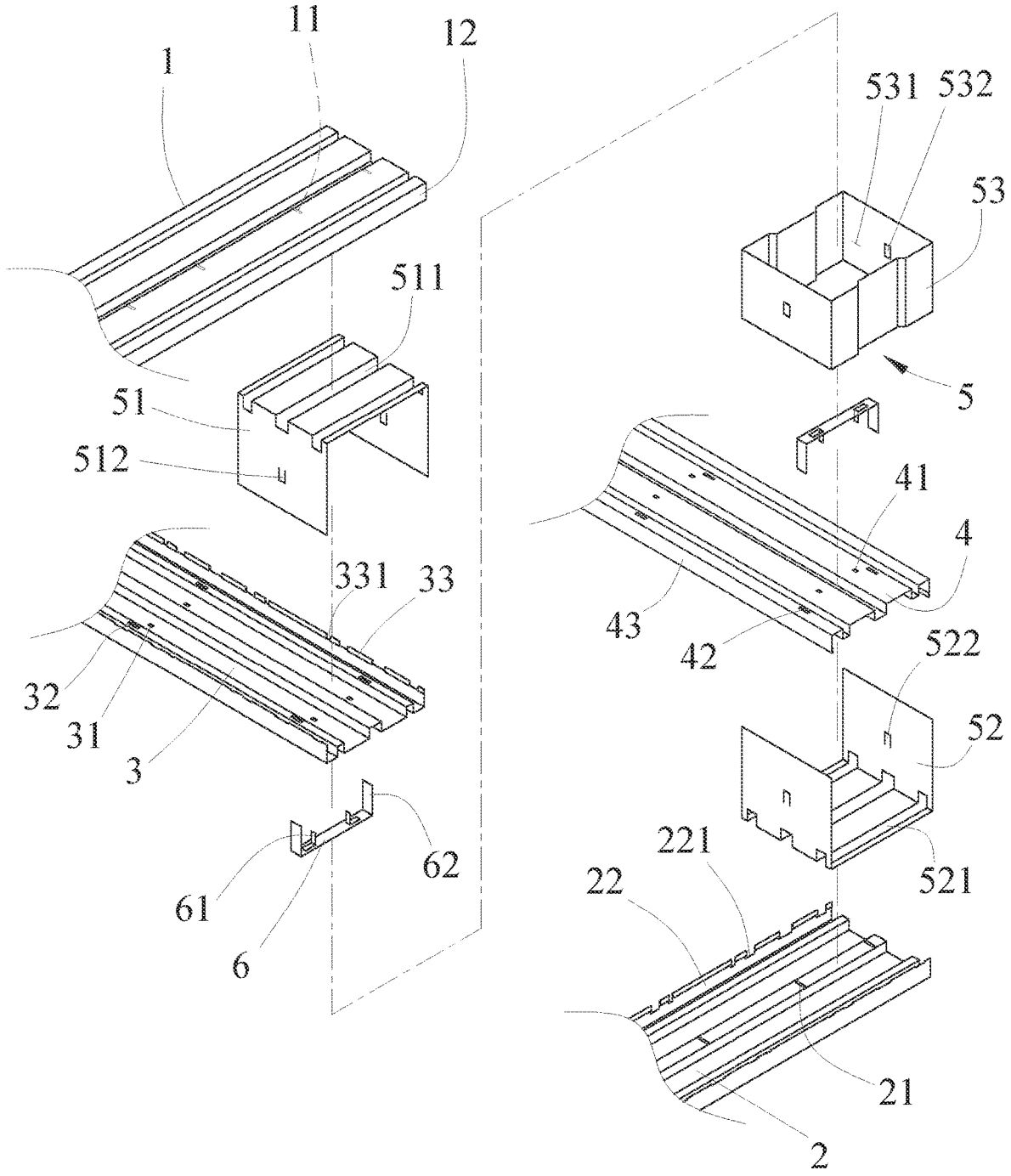
FIG. 2 is a partial exploded view of an embodiment according to the present invention.

The assemblable pallet includes seven top plates 1 disposed transversely and parallel to one another. Also refer to FIG. 2, the top plate 1 is a rectangular sheet with a corrugated surface. A plurality of first fastening holes 11 spaced apart from one another is disposed on a trough of the corrugated surface of the top plate 1 lengthwise while a first side wall 12 is extending downward from each of two long sides of the top plate 1.

In this embodiment, there are three bottom plates 2 disposed transversely, parallel to one another, and located under the top plate 1. The bottom plate 2 is a rectangular sheet provided with a corrugated surface. A plurality of second fastening holes 21 is spaced apart from one another and arranged at a crest of the corrugated surface of the bottom plate 2 lengthways while a second side wall 22 is extending upward from each of two long sides of the bottom plate 2 and provided with a plurality of first mounting recesses 221 spaced apart from one another and arranged lengthwise.

In this embodiment, there are three upper support plates 3 disposed longitudinally and parallel to one another. The upper support plate 3 is a rectangular sheet having a corrugated surface. A plurality pairs of third fastening holes 31 is spaced apart and disposed on two troughs of a surface of the upper support plate 3 lengthwise correspondingly while a plurality of pairs of fourth fastening holes 32 is spaced apart, arranged at two crests of the corrugated surface of the upper support plate 3 lengthwise correspondingly, and located adjacent to the third fastening holes 31. A third side wall 33 is extending upward from each of two long sides of the upper support plate 3 and provided with a plurality of second mounting recesses 331 spaced apart from one another. The upper support plates 3 are disposed under the top plates 1 and the first side walls 12 of the top plates 1 are mounted in the second mounting recesses 331 of the third side walls 33 of the upper support plates 3 correspondingly.

In this embodiment, there are three lower support plates 4 disposed longitudinally and parallel to one another. The three lower support plates 4 and the three upper support plates 3 are arranged relative to each other vertically and aligned with each other correspondingly. The lower support plate 4 is a rectangular sheet provided with a corrugated surface. A plurality pairs of fifth fastening holes 41 is spaced apart and disposed on two crests of the corrugated surface of the lower support plate 4 lengthwise correspondingly while a plurality of pairs of sixth fastening holes 42 is spaced apart, arranged at two troughs of the surface of the lower support plate 4 lengthwise correspondingly, and located adjacent to the fifth fastening holes 41. A fourth side wall 43 is extending downward from each of two long sides of the lower support plate 4. The lower support plates 4 are disposed over the bottom plates 2 and the fourth side walls 43 of the lower support plates 4 are mounted in the first mounting recesses 221 of the second side walls 22 of the bottom plates 2 correspondingly.

Figure 3:
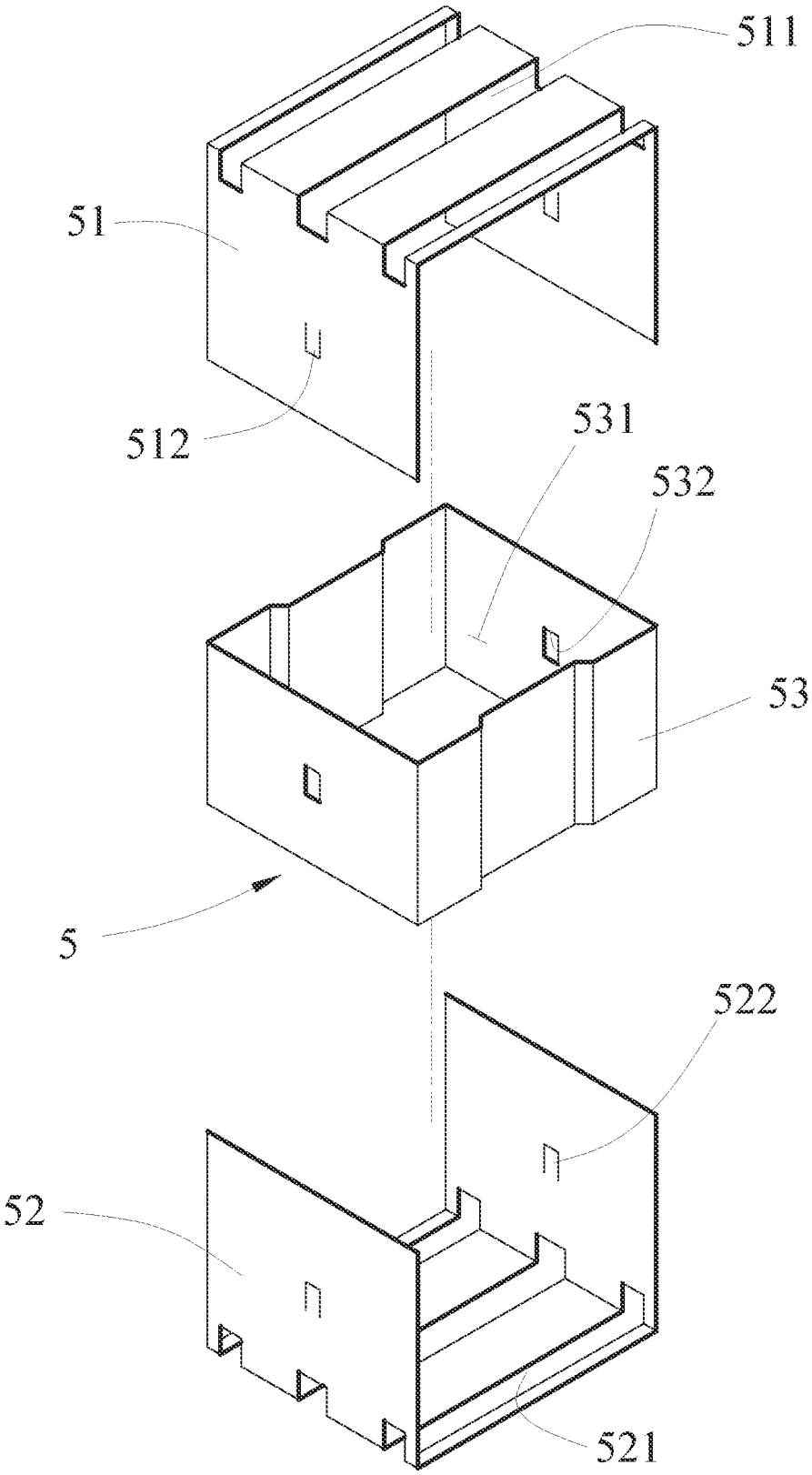
FIG. 3 is an exploded view of a foot in an embodiment according to the present invention.

In this embodiment, the present assemblable pallet includes nine feet 5 disposed on intersections where the three transverse bottom plates 2 and the three longitudinal lower support plates 4 cross each other correspondingly. Also refer to FIG. 3, each of the feet 5 consists of a n-shaped upper part 51, a U-shaped lower part 52, and a sleeve part 53. The n-shaped upper part 51, the U-shaped lower part 52, and the sleeve part 53 are all formed by bending of a sheet. A top surface of the n-shaped upper part 51 is clipped between the top plate 1 and the upper support plate 3 and provided with a plurality of transverse first grooves 511 while a first fastening piece 512 is arranged at each of two side walls of the n-shaped upper part 51. Thus the first side walls 12 of the top plate 1 and troughs on the surface of the top plate 1 are mounted into the first grooves 511 of the n-shaped upper part 51 correspondingly for positioning. A bottom surface of the U-shaped lower part 52 is clipped between the bottom plate 2 and the lower support plate 4 and provided with a plurality of transverse second grooves 521 while a second fastening piece 522 is arranged at each of two side walls of the U-shaped lower part 52. Thus the second side walls 22 of the bottom plate 2 and crests on the surface of the bottom plate 2 are mounted into the second grooves 521 of the U-shaped upper part 52 correspondingly for positioning. The n-shaped upper part 51 and the U-shaped lower part 52 are aligned with each other vertically and mounted into a mounting hole 531 of the sleeve part 53. A seventh fastening hole 532 is mounted to each of two side walls of the sleeve part 53. The first fastening pieces 512 on the two side walls of the n-shaped upper part 51 are inserted through the seventh fastening holes 532 on the two side walls of the sleeve part 53 and bent to abut against outer walls of the sleeve part 53 for being locked and connected with the sleeve part 53. The second fastening pieces 522 on the two side walls of the U-shaped lower part 52 are also inserted through the seventh fastening holes 532 on the two side walls of the sleeve part 53 and bent to abut against the outer walls of the sleeve part 53 for being locked and connected with the sleeve part 53.

The fasteners 6 are disposed on intersections where the seven transverse top plates 1 and the three longitudinal upper support plates 3 cross each other and intersections where the three transverse bottom plates 2 and the three longitudinal lower support plates 4 cross each other. The fastener 6 is a long sheet having two third fastening pieces 61 and two fourth fastening pieces 62 while the third fastening piece 61 and the fourth fastening pieces 62 are formed at an area from a center of the fastener 6 to each of two opposite sides of the fastener 6 in turn. A height of the two third fastening pieces 61 is smaller than a height of the two fourth fastening pieces 62. The two third fastening pieces 61 of the fastener 6 arranged at the intersection between the top plate 1 and the upper support plate 3 are inserted through the two third fastening holes 31 of the upper support plate 3 and then bent to abut against the top surface of the upper support plate 3 for being locked and connected with the upper support plate 3. The two fourth fastening pieces 62 of the fastener 6 are inserted through the two fourth fastening holes 32 of the upper support plate 3 and the two first fastening holes 11 of the top plate 1 aligned with the fourth fastening holes 32 in turn and then also bent to abut against the top surface of the top plate 1 for being locked and connected with the top plate 1. Thereby the top plate 1 and the upper support plate 3 are connected and fixed by the fastener 6. Moreover, the two third fastening pieces 61 of the fastener 6 arranged at the intersection between the bottom plate 2 and the lower support plate 4 are inserted through the two fifth fastening holes 41 of the lower support plate 4 and then bent to abut against the bottom surface of the lower support plate 4 for being locked and connected with the lower support plate 4. Next the two fourth fastening pieces 62 of the fastener 6 are inserted through the two sixth fastening holes 42 of the lower support plate 4 and the two second fastening holes 21 of the bottom plate 2 aligned with the sixth fastening holes 42 in turn and then also bent to abut against the bottom surface of the bottom plate 2 for being locked and connected with the bottom plate 2. Thereby the bottom plate 2 and the lower support plate 4 are connected and fixed by the fastener 6.

While being assembled, the three bottom plates 2 are disposed transversely and in parallel to one another and the three lower support plates 4 are arranged longitudinally in parallel and located over the three bottom plates 2. Then each of the intersections between the bottom plates 2 and the lower support plates 4 is provided with one of the fasteners 6 while the two third fastening pieces 61 of the fastener 6 are inserted through the two fifth fastening holes 41 of the lower support plate 4 and then bent to abut against the bottom surface of the lower support plate 4 for being locked and connected with the lower support plate 4. Later the U-shaped lower part 52 of the respective feet 5 is disposed on the intersection between the bottom plate 2 and the lower support plate 4. The bottom surface of the U-shaped lower part 52 is clipped between the bottom plate 2 and the lower support plate 4 and both the two second side walls 22 and the crests on the surface of the bottom plate 2 are mounted into the second grooves 521 on the bottom surface of the U-shaped lower part 52 correspondingly. Next the fourth side walls 43 of the lower support plate 4 are mounted into the first mounting recesses 221 of the second side walls 22 of the bottom plate 2 for being positioned therein. Then the two fourth fastening pieces 62 of the fastener 6 are inserted through the two sixth fastening holes 42 of the lower support plate 4 and the two second fastening holes 21 of the bottom plate 2 in turn and then also bent to abut against the bottom surface of the bottom plate 2 for being locked and connected with the bottom plate 2. Thereby assembly of a lower half of the present assemblable pallet formed by the bottom plates 2, the lower support plates 4, and the U-shaped lower parts 52 of the feet 5 has been completed.

Figure 4:
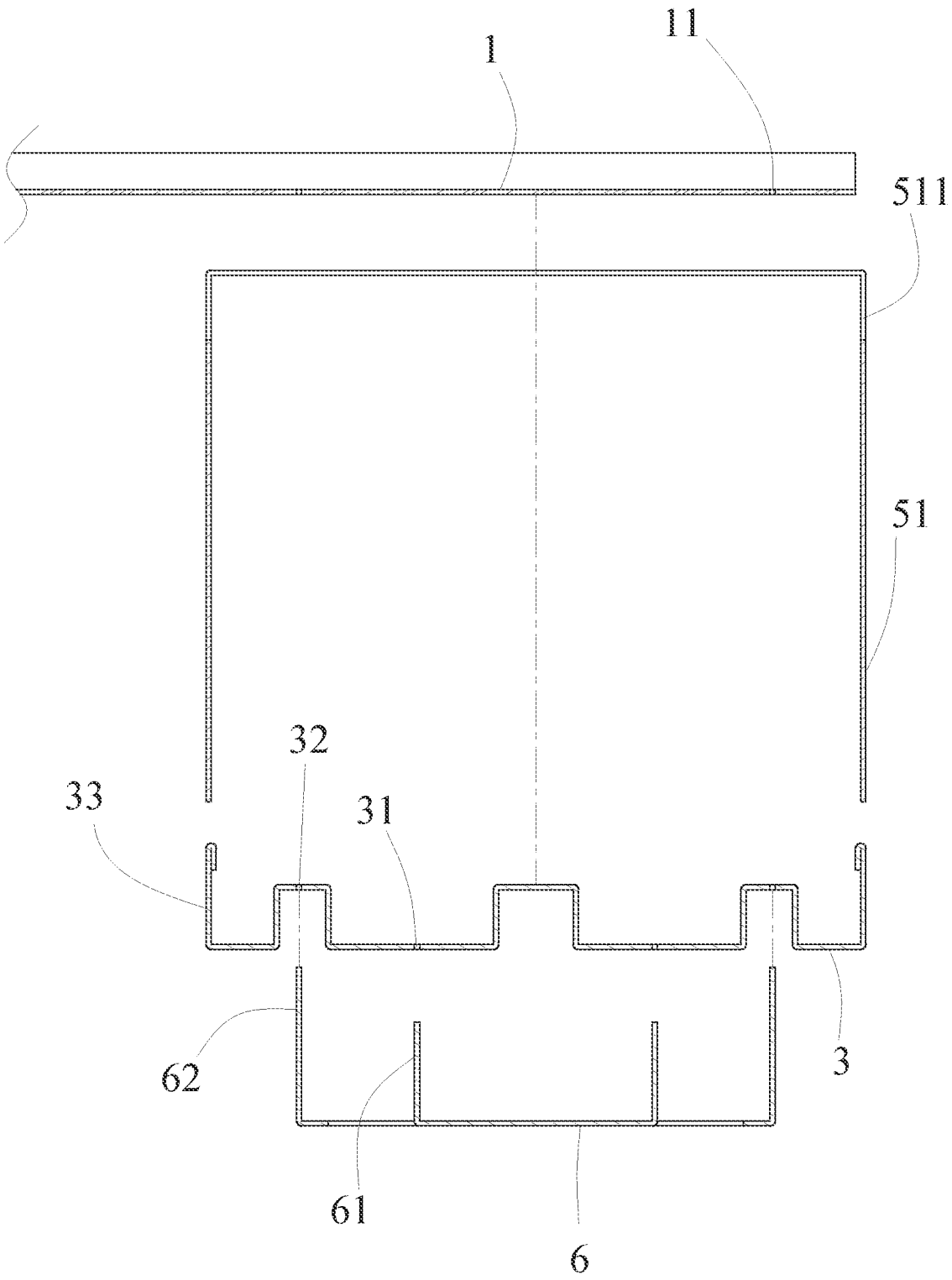
FIG. 4 is a partial sectional view of an embodiment during assembly process according to the present invention.
Figure 5:
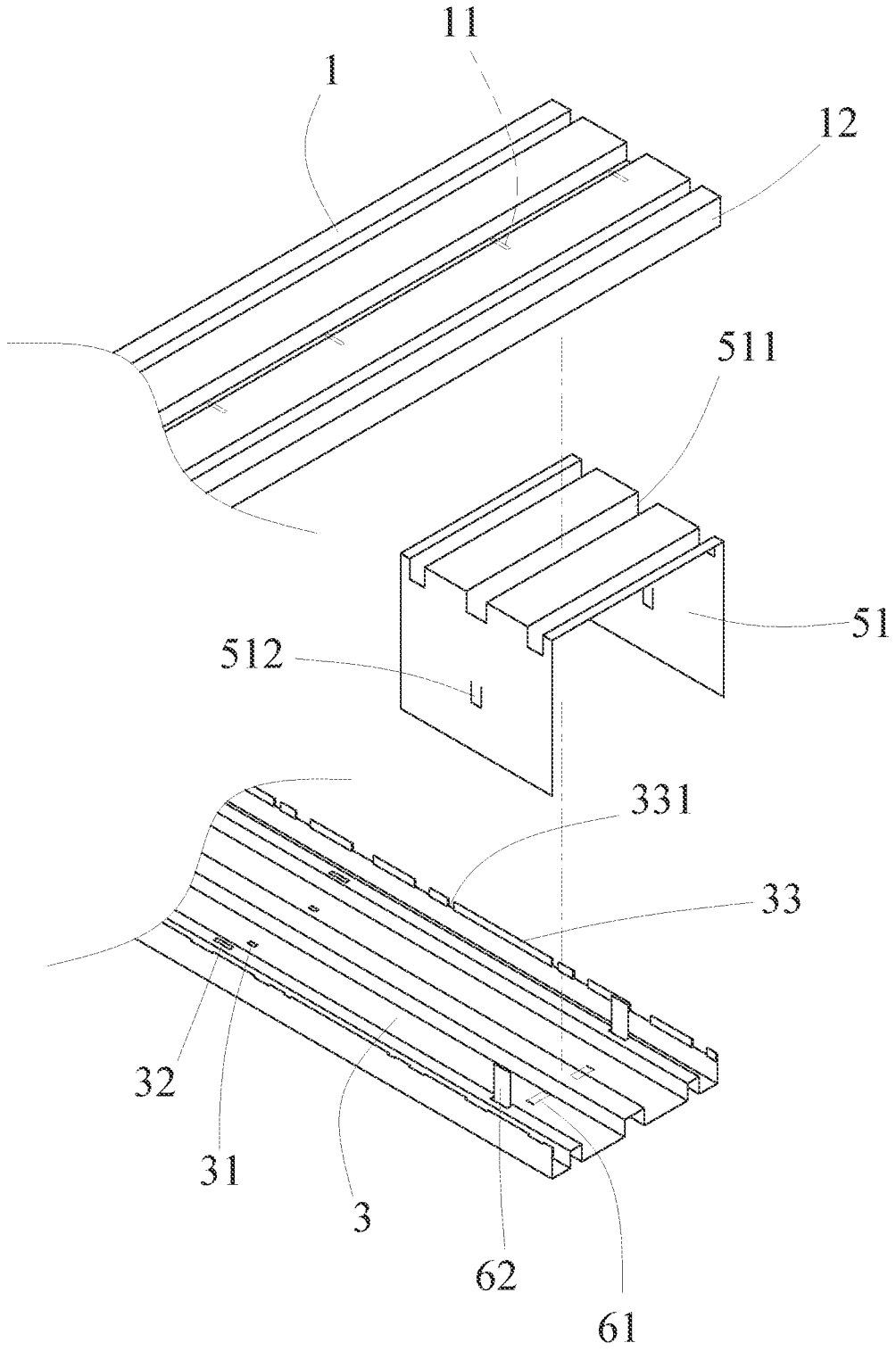
FIG. 5 is a partial exploded view of an embodiment according to the present invention.
Figure 6:
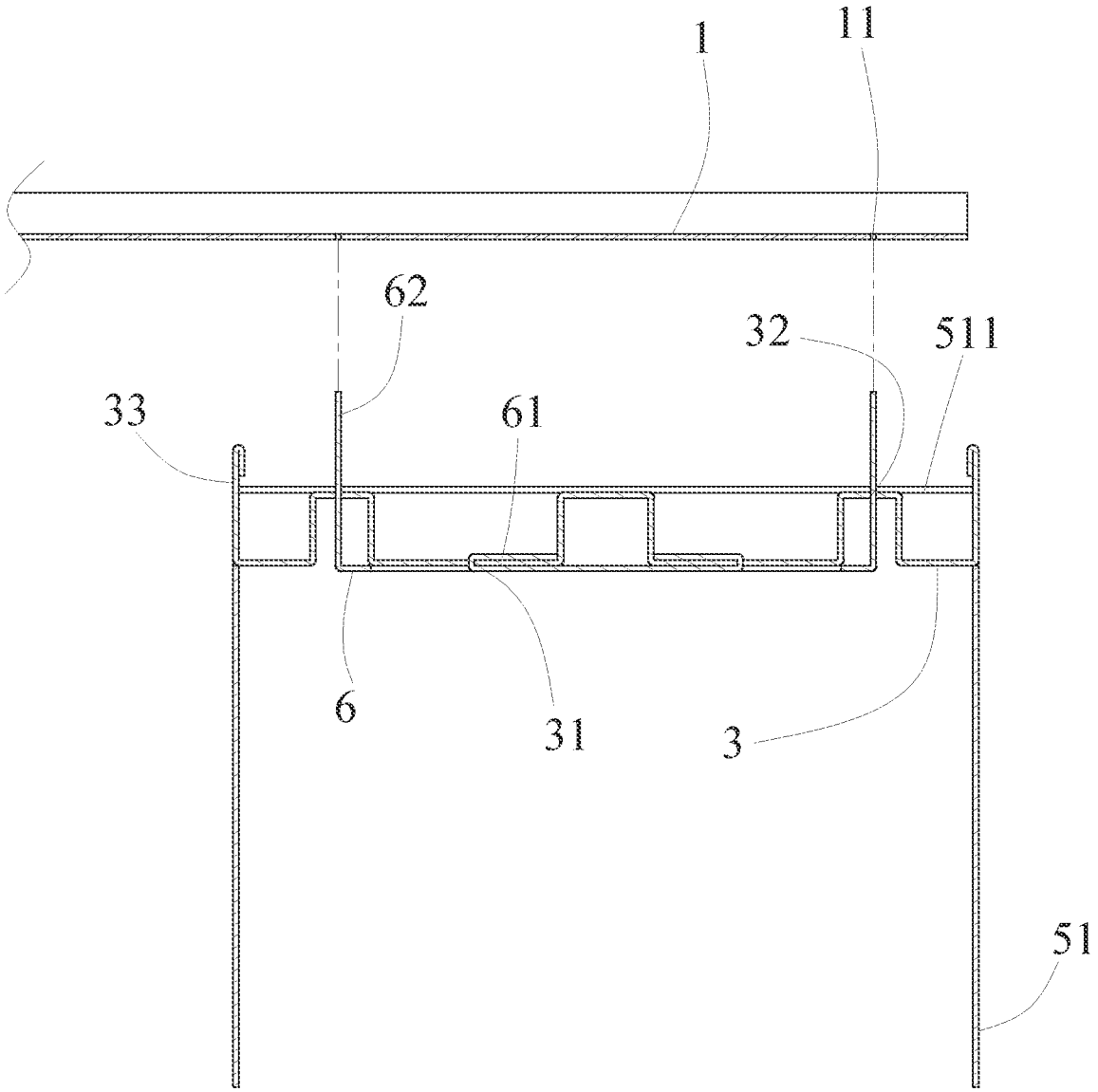
FIG. 6 is another partial sectional view of an embodiment during assembly process according to the present invention.
Figure 7:
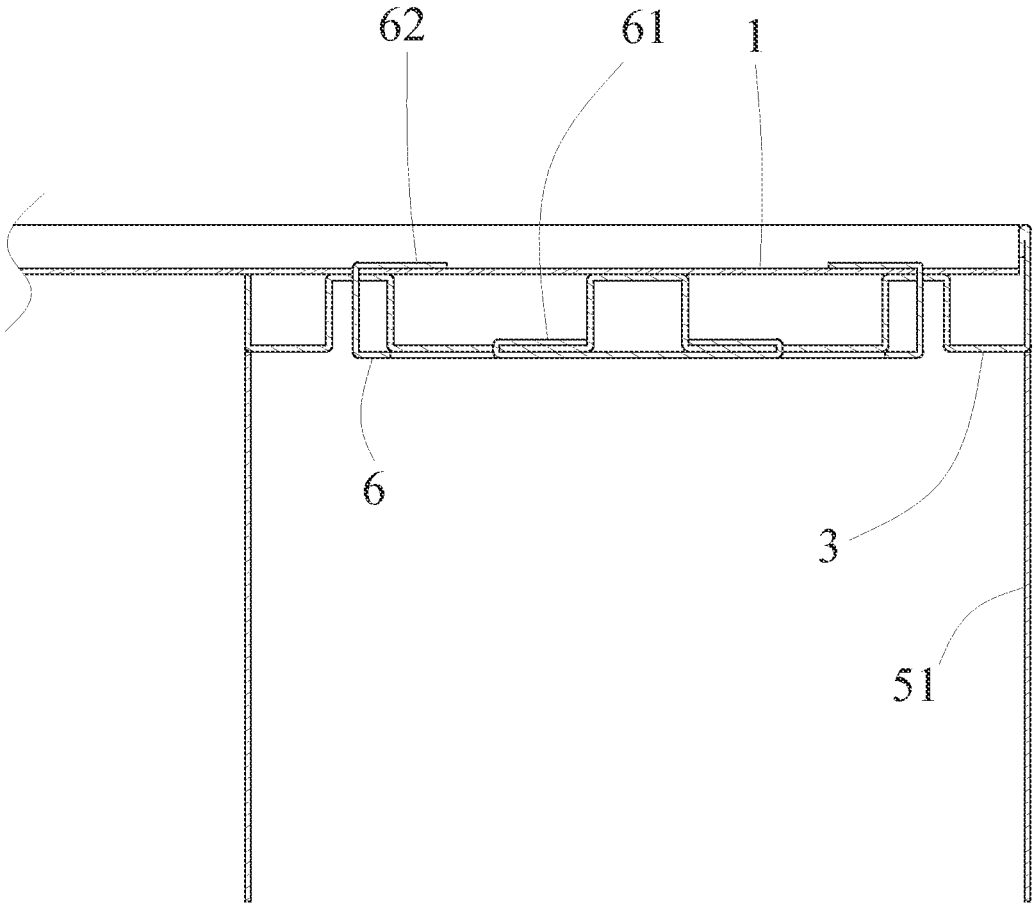
FIG. 7 is a further partial sectional view of an embodiment during assembly process according to the present invention.

Next the three upper support plates 3 are arranged longitudinally and in parallel and the seven top plates 1 are disposed transversely, in parallel, and located over the three upper support plates 3. Then each of the intersections between the top plates 1 and the upper support plates 3 is provided with one of the fasteners 6. Also refer to FIG. 4 and FIG. 5, the two third fastening pieces 61 of the fastener 6 are inserted through the two third fastening holes 31 of the upper support plate 3 and then bent to abut against the top surface of the upper support plate 3 for being locked and connected with the upper support plate 3. Later the n-shaped upper part 51 of the respective feet 5 is disposed on the intersection between the top plate 1 and the upper support plate 3. The top surface of the n-shaped upper part 51 is clipped between the top plate 1 and the upper support plate 3 and the first side walls 12 and the troughs on the surface of the top plate 1 are mounted into the first grooves 511 on the top surface of the n-shaped upper part 51 correspondingly. The first side walls 12 of the top plate 1 are mounted into the second mounting recesses 331 on the third side walls 33 of the upper support plate 3 for being positioned therein. Also refer to FIG. 6, and FIG. 7, the two fourth fastening pieces 62 of the fastener 6 are inserted through the two fourth fastening holes 32 of the upper support plate 3 and the two first fastening holes 11 of the top plate 1 in turn and then bent to abut against the top surface of the top plate 1 for being locked and connected with the top plate 1. Thereby assembly of an upper half of the present assemblable pallet formed by the top plates 1, the upper support plates 3, and the n-shaped upper parts 51 of the feet 5 has been completed.

Figure 8:
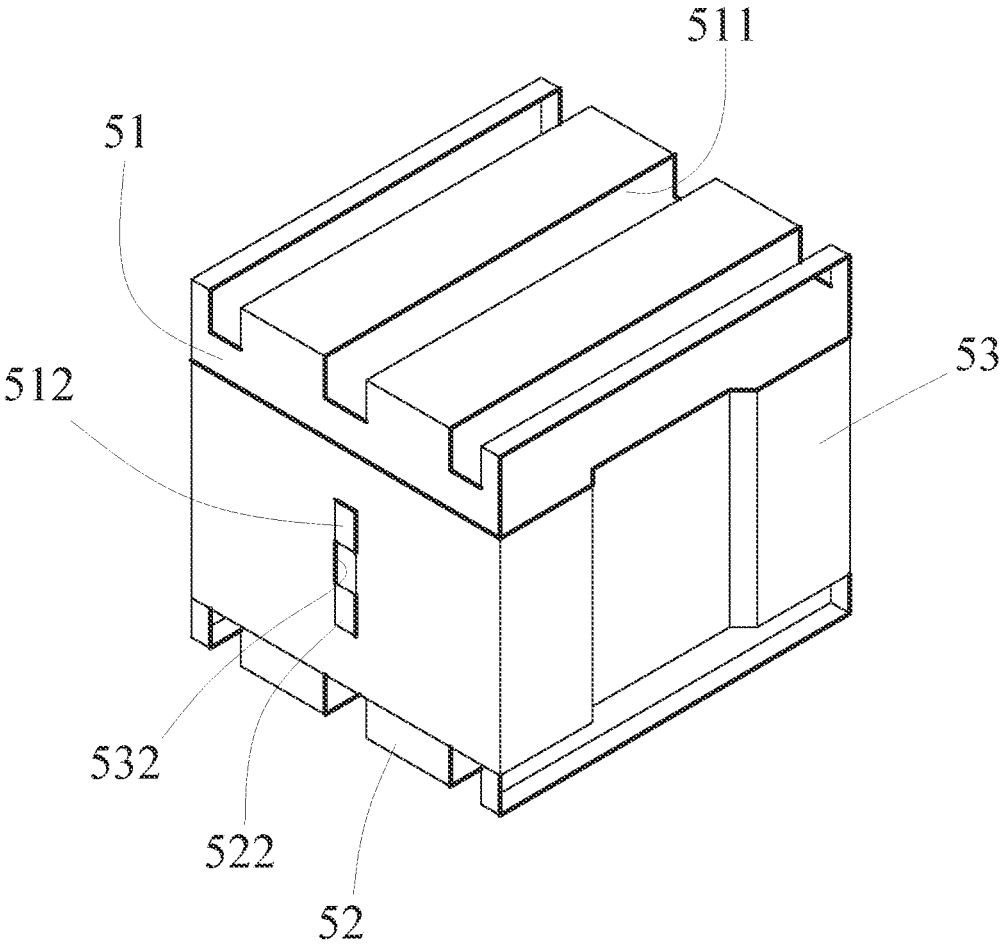
FIG. 8 is a perspective view of a foot in an embodiment according to the present invention.
Figure 9:
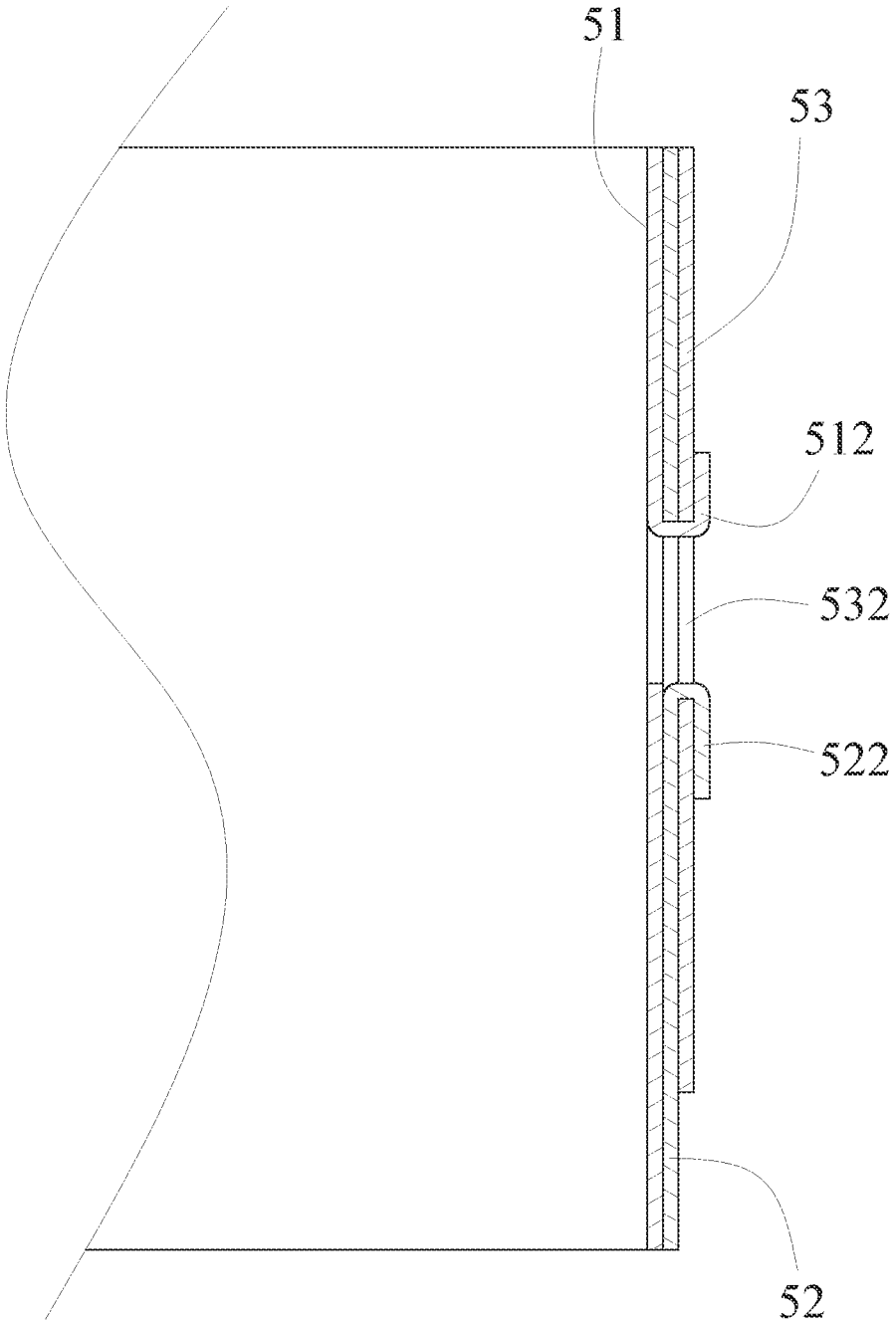
FIG. 9 is another partial sectional view of a foot in an embodiment during assembly process according to the present invention.

Refer to FIG. 8 and FIG. 9, each of the sleeve parts 53 of the respective feet 5 is fit around the U-shaped lower part 52 of the foot 5 already connected with both the bottom plate 2 and the lower support plate 4. Then the second fastening pieces 522 on the two side walls of the U-shaped lower part 52 are pulled and inserted through the seventh fastening holes 532 on the two side walls of the sleeve part 53 and further bent to abut against the outer walls of the sleeve part 53 for being locked and connected with the sleeve part 53. Later an assembly of the top plates 1, the upper support plates 3, and the n-shaped upper parts 51 of the feet 5 connected is disposed over an assembly of the bottom plates 2, the lower support plates 4, the U-shaped lower parts 52 of the feet 5, and the sleeve parts 53 connected. Then the n-shaped upper parts 51 of the respective feet 5 are mounted into the mounting holes 531 of the sleeve parts 53 correspondingly to be joined with the U-shaped lower parts 52 already mounted in the sleeve parts 53. Next the first fastening pieces 512 on the two side walls of the n-shaped upper part 51 are pulled and inserted through the seventh fastening holes 532 on the two side walls of the sleeve part 53 and further bent to abut against the outer walls of the sleeve part 53 for being locked and connected with the sleeve part 53.

Figure 10:
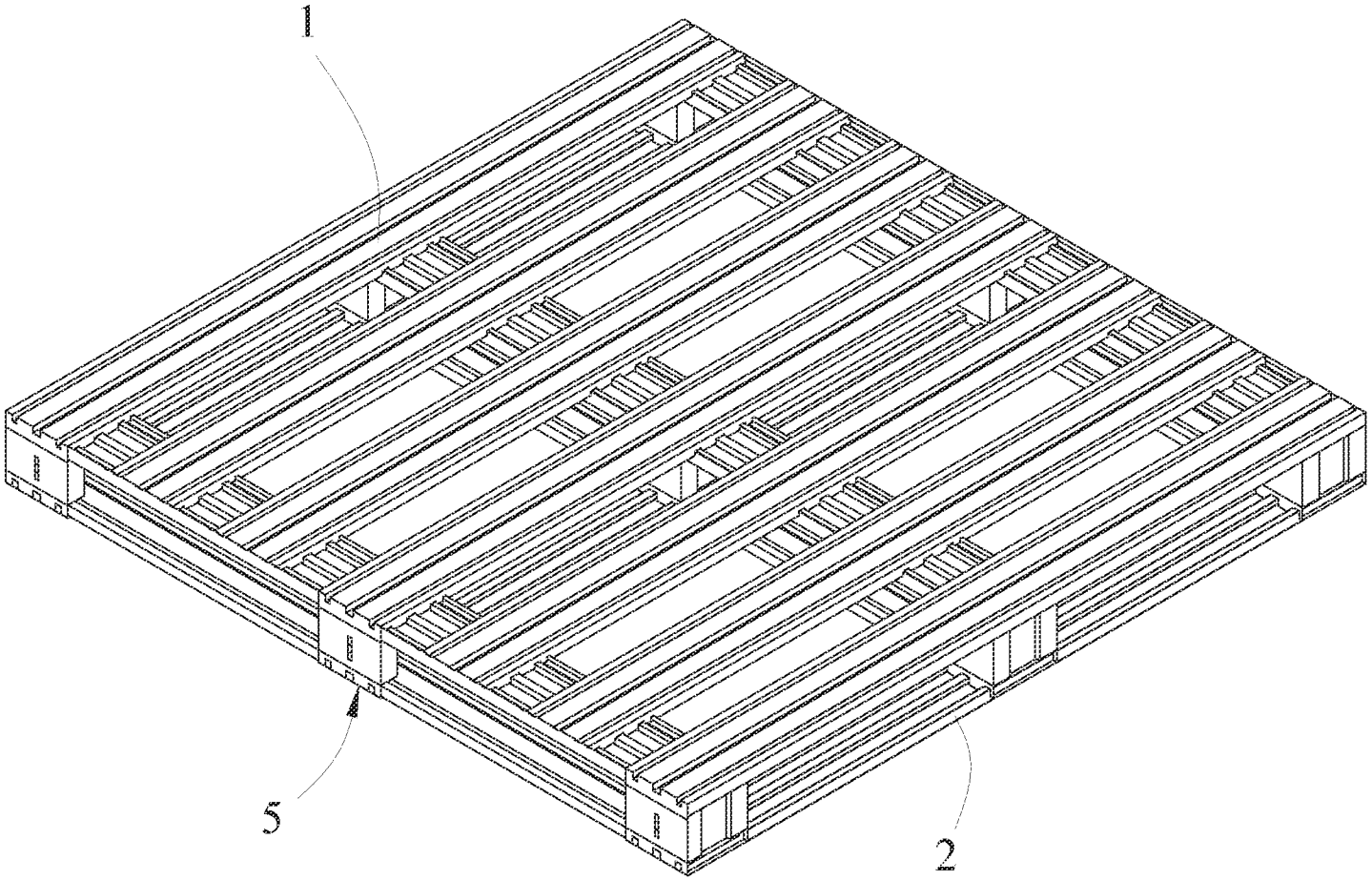
FIG. 10 is a perspective view of an embodiment according to the present invention.

As shown in FIG. 10, the upper half and the lower half of the present assemblable pallet are connected by assembly of the n-shaped upper parts 51, the U-shaped lower parts 52, and the sleeve parts 53 of the respective feet 5 so as to form a complete assemblable pallet. There is no need to use any fasteners such as screws and rivets. Thus both cost of the fasteners such as screws or rivets and time required for assembling the fasteners can be saved, Furthermore, unexpected loosening of the sheets connected by the fasteners (such as screws) in the pellet caused by vibration can be avoided so that the pallet used for transportation of goods is more safe to use.

Figure 11:
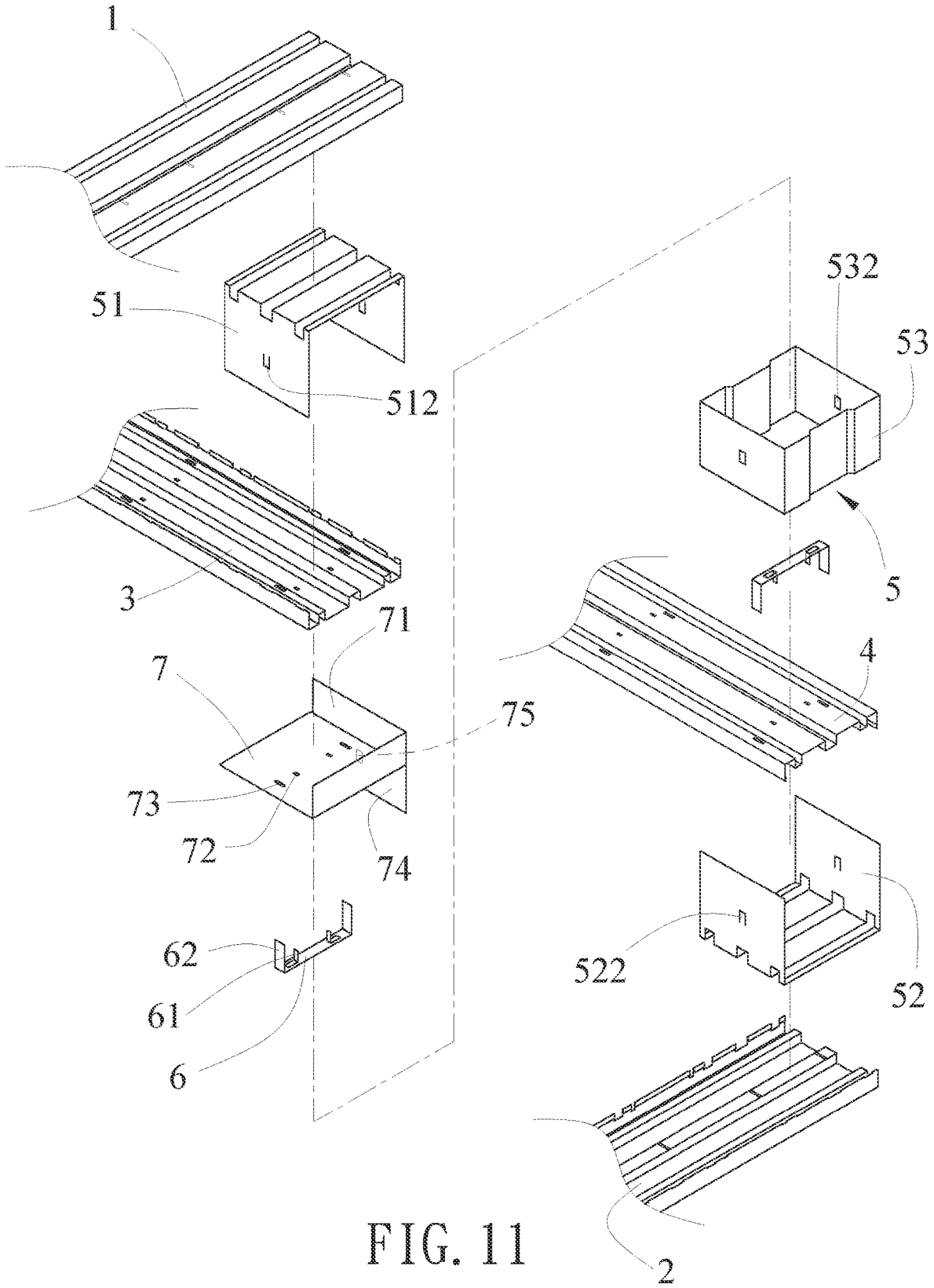
FIG. 11 is a partial exploded view of another embodiment according to the present invention.
Figure 12:
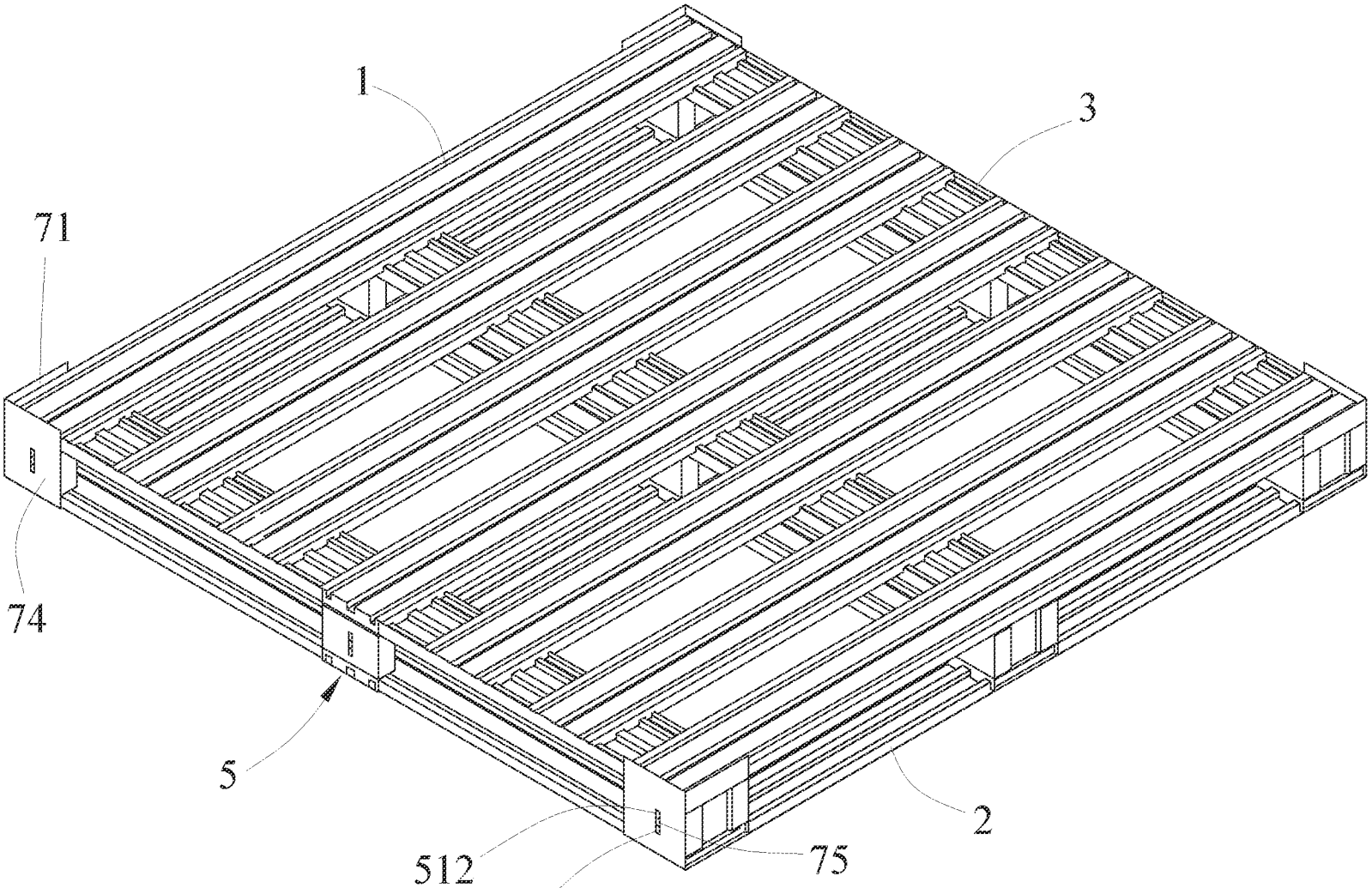
FIG. 12 is a perspective view of another embodiment according to the present invention.
Figure 13:
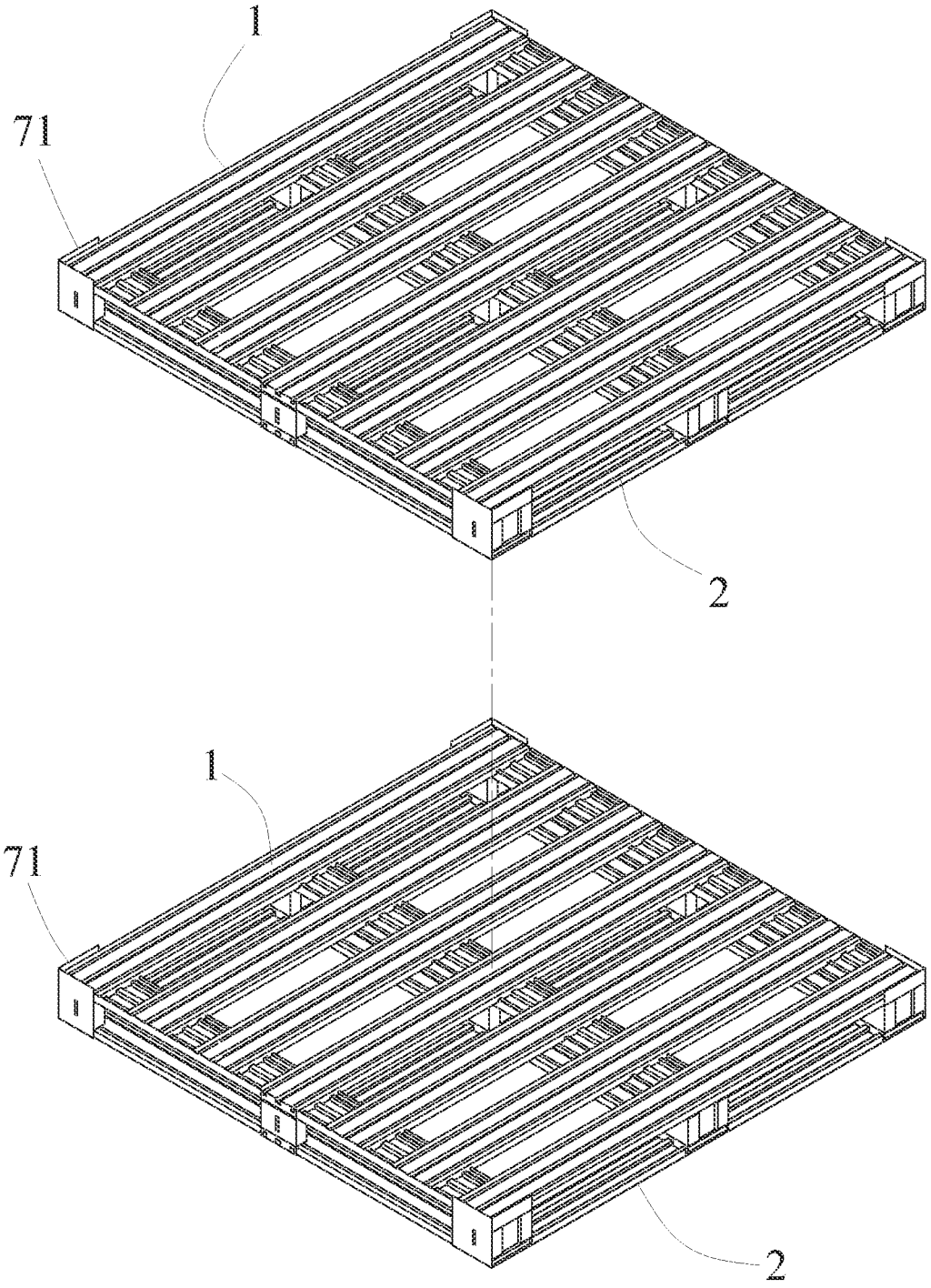
FIG. 13 is a perspective view of a pellet stacked on top of another pallet of another embodiment according to the present invention.

Refer to FIG. 11, another embodiment of the present invention is provided. In this embodiment, a positioning plate 7 which is a rectangular sheet is arranged at each of four corners of the present rectangular assemblable pallet. The positioning plate 7 is composed of a stopping piece 71 disposed on each of two adjacent sides thereof and extending upward, two eighth fastening holes 72 opposite to each other and arranged at the positioning plate 7, two ninth fastening holes 73 opposite to each other and located adjacent to the eighth fastening holes 72, a fixing piece 74 disposed on the same side as one of the stopping pieces 71 and extending downward, and a tenth fastening hole 75 mounted to the fixing piece 74. An angle between the two stopping pieces 71 is 90 degrees. While being assembled, the plurality of the positioning plates 7 is arranged at the four corners of the rectangular assemblable pallet correspondingly. The upper support plate 3 is disposed over the positioning plate 7 and the two eighth fastening holes 72 and the two ninth fastening holes 73 of the positioning plate 7 are respectively aligned with the two third fastening holes 31 and the two fourth fastening holes 32 of the upper support plate 3. The two third fastening pieces 61 of the fastener 6 are inserted through the two eighth fastening holes 72 of the positioning plate 7 and the two third fastening holes 31 of the upper support plate 3 in turn and then bent to abut against the top surface of the upper support plate 3 for locking and connecting the positioning plate 7 with the upper support plate 3. Similarly, the two fourth fastening pieces 62 of the fastener 6 are inserted through the two ninth fastening holes 73 of the positioning plate 7, the two fourth fastening holes 32 of the upper support plate 3, and the two first fastening holes 11 of the top plate 1 in turn and then bent to abut against the top surface of the top plate 1 for being locked and connected with the top plate 1. Next an upper half of the present assemblable pallet formed by the top plates 1, the upper support plates 3, the positioning plate 7, and the n-shaped upper parts 51 of the feet 5 connected is combined with a lower half of the pallet so that the n-shaped upper parts 51 of the feet 5 are mounted into the mounting holes 531 of the sleeve parts 53 correspondingly to be joined with the U-shaped lower parts 52 already mounted in the sleeve parts 53. Moreover, the fixing piece 74 of the positioning plate 7 is covering the sleeve part 53. Then the first fastening piece 512 of the n-shaped upper part 51 is pulled and inserted through the seventh fastening hole 532 on the side wall of the sleeve part 53 and the tenth fastening hole 75 of the fixing piece 74 in turn and further bent to abut against an outer wall of the fixing piece 74. Similarly, the second fastening piece 522 of the U-shaped lower part 52 is also pulled and inserted through the seventh fastening hole 532 on the side wall of the sleeve part 53 and the tenth fastening hole 75 of the fixing piece 74 and then bent to abut against the outer wall of the of the fixing piece 74. The second fastening piece 522 works together with the first fastening pieces 512 to lock and connect the sleeve part 53 with the fixing piece 74. As shown in FIG. 12, assembly of the embodiment with the positioning plates 7 is completed. As shown in FIG. 13, while stacking a plurality of the pallets on top of one another, four corners of an upper pallet are stopped and limited by the stopping pieces 71 of the positioning plates 7 on four corners of a lower pallet to prevent the upper and the lower pallets from sliding and thus the pallets are stacked neatly. When good are placed on the pallet with the positioning plates 7, they are also stopped and limited by the stopping pieces 71 of the positioning plates 7. Thus the goods are mounted stably, without sliding and falling off the pallet. The goods are secured on the pallet and transported in a safe way.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. An assemblable pallet comprising:

a plurality of top plates each of which is a rectangular sheet and provided with a plurality of first fastening holes arranged at the rectangular top plate lengthwise and spaced apart from one another;

a plurality of bottom plates each of which is a rectangular sheet and provided with a plurality of second fastening holes arranged at the rectangular bottom plate lengthwise and spaced apart from one another; wherein the top plates and the bottom plate are disposed transversely while the top plates are arranged over the bottom plates;

a plurality of upper support plates each of which is a rectangular sheet and provided with a plurality pairs of third fastening holes spaced apart and disposed lengthwise and a plurality of pairs of fourth fastening holes spaced apart, arranged lengthwise, and located adjacent to the third fastening holes;

a plurality of lower support plates each of which is a rectangular sheet and provided with a plurality pairs of fifth fastening holes spaced apart and disposed lengthwise and a plurality of pairs of sixth fastening holes spaced apart, arranged lengthwise, and located adjacent to the third fastening holes; wherein the upper support plates and the lower support plates are arranged longitudinally, relative to each other vertically, and aligned with each other correspondingly; wherein the upper support plates are disposed under the top plates and the lower support plates are arranged over the bottom plates;

a plurality of feet which is disposed on intersections where the transverse bottom plates and the longitudinal lower support plates cross each other correspondingly; each of the feet includes a n-shaped upper part, a U-shaped lower part, and a sleeve part; a top surface of the n-shaped upper part is clipped between the top plate and the upper support plate and provided with a first fastening piece arranged at each of two side walls of the n-shaped upper part; a bottom surface of the U-shaped lower part is clipped between the bottom plate and the lower support plate and provided with a second fastening piece disposed on each of two side walls of the U-shaped lower part; the n-shaped upper part and the U-shaped lower part are aligned with each other vertically and then mounted into a mounting hole of the sleeve part; a seventh fastening hole is mounted to each of two side walls of the sleeve part; the first fastening pieces on the two side walls of the n-shaped upper part are inserted through the seventh fastening holes on the two side walls of the sleeve part and bent to abut against outer walls of the sleeve part for being locked and connected with the sleeve part while the second fastening pieces on the two side walls of the U-shaped lower part are inserted through the seventh fastening holes on the two side walls of the sleeve part and bent to abut against the outer walls of the sleeve part for being locked and connected with the sleeve part; and a plurality of fasteners which is disposed on intersections where the transverse top plates and the longitudinal upper support plates cross each other and intersections where the transverse bottom plates and the longitudinal lower support plates cross each other correspondingly; a third fastening piece and a fourth fastening piece are formed at an area from a center of the fastener to each of two opposite sides of the fastener in turn while a height of the two third fastening pieces is smaller than a height of the two fourth fastening pieces; wherein the two third fastening pieces of the fastener arranged at the intersection between the top plate and the upper support plate are inserted through the two third fastening holes of the upper support plate and then bent to abut against a top surface of the upper support plate for being locked and connected with the upper support plate; the two fourth fastening pieces of the fastener are inserted through the two fourth fastening holes of the upper support plate and the two first fastening holes of the top plate aligned with the two fourth fastening holes in turn and then bent to abut against a top surface of the top plate for being locked and connected with the top plate; wherein the two third fastening pieces of the fastener arranged at the intersection between the bottom plate and the lower support plate are inserted through the two fifth fastening holes of the lower support plate and then bent to abut against a bottom surface of the lower support plate for being locked and connected with the lower support plate; the two fourth fastening pieces of the fastener are inserted through the two sixth fastening holes of the lower support plate and the two second fastening holes of the bottom plate aligned with the sixth fastening holes in turn and then bent to abut against a bottom surface of the bottom plate for being locked and connected with the bottom plate.

2. The assemblable pallet as claimed in claim 1, wherein a first side wall is extending downward from each of two long sides of the top plate while a third side wall is extending upward from each of two long sides of the upper support plate and provided with a plurality of second mounting recesses spaced apart from one another and arranged lengthwise; the first side walls of the top plate are mounted into the second mounting recesses on the third side walls of the upper support plate correspondingly.

3. The assemblable pallet as claimed in claim 1, wherein a second side wall is extending upward from each of two long sides of the bottom plate and provided with a plurality of first mounting recesses spaced apart from one another and arranged lengthwise while a fourth side wall is extending downward from each of two long sides of the lower support plate; wherein the fourth side walls of the lower support plates are mounted in the first mounting recesses on the second side walls of the bottom plates correspondingly.

4. The assemblable pallet as claimed in claim 1, wherein the top plate, the bottom plate, the upper support plate, and the lower support plate are all provided with a corrugated surface.

5. The assemblable pallet as claimed in claim 4, wherein a plurality of transverse first grooves is disposed on the top surface of the n-shaped upper part of the feet and troughs on the surface of the top plate are mounted in the first grooves of the n-shaped upper part correspondingly for positioning; a plurality of transverse second grooves is arranged at the bottom surface of the U-shaped lower part of the feet and crests on the surface of the bottom plate are mounted into the second grooves of the U-shaped upper part correspondingly for positioning.

6. The assemblable pallet as claimed in claim 1, wherein the assemblable pallet is rectangular and having a plurality of positioning plates which is arranged at four corners of the assemblable pallet; wherein the positioning plate is a rectangular sheet and composed of a stopping piece disposed on each of two adjacent sides thereof and extending upward, two opposite eighth fastening holes arranged at the positioning plate, and two opposite ninth fastening holes disposed on the positioning plate and located adjacent to the eighth fastening holes;

an angle formed between the two stopping pieces is 90 degrees;

wherein the upper support plate is disposed over the positioning plate while the two eighth fastening holes and the two ninth fastening holes of the positioning plate are respectively aligned with the two third fastening holes and the two fourth fastening holes of the upper support plate;

the two third fastening pieces of the fastener are inserted through the two eighth fastening holes of the positioning plate and the two third fastening holes of the upper support plate in turn and then bent to abut against the top surface of the upper support plate; the two fourth fastening pieces of the fastener are inserted through the two ninth fastening holes of the positioning plate, the two fourth fastening holes of the upper support plate, and the two first fastening holes of the top plate in turn and then bent to abut against the top surface of the top plate.

7. The assemblable pallet as claimed in claim 6, wherein a fixing piece is disposed on the same side as one of the stopping pieces and extending downward; the fixing piece is covering the sleeve part of the feet correspondingly.

8. The assemblable pallet as claimed in claim 1, wherein the assemblable pallet includes the seven top plates disposed transversely and parallel to one another, the three bottom plates disposed transversely and parallel to one another, the three upper support plates disposed longitudinally and parallel to one another, the three lower support plates disposed longitudinally and parallel to one another, the nine feet disposed on the intersections where the three transverse bottom plates and the three longitudinal lower support plates cross each other correspondingly, the plurality of fasteners disposed on the intersections where the seven transverse top plates and the three longitudinal upper support plates cross each other and the intersections where the three transverse bottom plates and the three longitudinal lower support plates cross each other.

9. The assemblable pallet as claimed in claim 1, wherein the top plates, the bottom plates, the upper support plates, the lower support plates, the feet, and the fasteners are made of metals.

10. The assemblable pallet as claimed in claim 1, wherein the top plates, the bottom plates, the upper support plates, the lower support plates, the feet, and the fasteners are made of aluminum or steel coated with zinc.

* * * * *